US006854391B2

(12) United States Patent
Latunski et al.

(10) Patent No.: US 6,854,391 B2
(45) Date of Patent: Feb. 15, 2005

(54) LITHOGRAPHIC PRINTING METHOD AND MATERIALS

(75) Inventors: Mark D. Latunski, Morrice, MI (US); Matthew S. Newman, Ann Arbor, MI (US); Dennis R. Gelarden, Livonia, MI (US); Graham C. Battersby, Ann Arbor, MI (US)

(73) Assignee: Flint Ink Corporation, Ann Arbor, MI (US)

( * ) Notice: Subject to any disclaimer, the term of this patent is extended or adjusted under 35 U.S.C. 154(b) by 0 days.

(21) Appl. No.: 10/167,059

(22) Filed: Jun. 10, 2002

(65) Prior Publication Data

US 2003/0226462 A1 Dec. 11, 2003

(51) Int. Cl.[7] ..... B41C 1/10

(52) U.S. Cl. ..... 101/451; 101/457; 101/463.1; 430/276.1

(58) Field of Search ..... 101/450.1, 451, 101/457, 458, 459, 463.1; 430/270.1, 271.1, 276.1, 302, 303

(56) References Cited

U.S. PATENT DOCUMENTS

| | | | | | |
|---|---|---|---|---|---|
| 3,624,227 | A | * | 11/1971 | Hwang | 430/141 |
| 3,881,998 | A | | 5/1975 | Miyosawa | |
| 4,033,919 | A | | 7/1977 | Lawson | |
| 4,349,391 | A | | 9/1982 | Schell | |
| 4,783,395 | A | | 11/1988 | Hsieh et al. | |
| 4,983,478 | A | * | 1/1991 | Stahlhofen et al. | 430/14 |
| 5,061,607 | A | * | 10/1991 | Walls | 430/309 |
| 5,302,460 | A | * | 4/1994 | Pliefke et al. | 428/461 |
| 5,368,974 | A | * | 11/1994 | Walls et al. | 430/156 |
| 5,518,866 | A | * | 5/1996 | Coppens et al. | 430/331 |
| 5,807,659 | A | * | 9/1998 | Nishimiya et al. | 430/302 |
| 6,060,209 | A | * | 5/2000 | Kondo et al. | 430/204 |
| 6,114,089 | A | * | 9/2000 | Takita et al. | 430/278.1 |
| 6,132,498 | A | * | 10/2000 | Matsumoto | 106/2 |
| 6,455,229 | B1 | * | 9/2002 | Vermeersch et al. | 430/302 |
| 6,566,029 | B2 | * | 5/2003 | Kawamura et al. | 430/138 |
| 6,607,866 | B1 | * | 8/2003 | Kawamura et al. | 430/270.1 |
| 2002/0051934 | A1 | | 5/2002 | Nakamura et al. | 430/270.1 |
| 2002/0096074 | A1 | | 7/2002 | Hartmann et al. | 101/465 |
| 2002/0106583 | A1 | * | 8/2002 | Kawamura et al. | 430/271.1 |

FOREIGN PATENT DOCUMENTS

| | | |
|---|---|---|
| CH | 396 055 | 1/1966 |
| DE | 25 04 594 A1 | 8/1975 |
| DE | 30 06 094 A1 | 8/1981 |
| DE | 41 17 126 A1 | 11/1992 |
| GB | 967598 | 8/1964 |

* cited by examiner

*Primary Examiner*—Stephen R. Funk
(74) *Attorney, Agent, or Firm*—Harness, Dickey & Pierce, P.L.C.

(57) ABSTRACT

A conditioner composition for a printing plate with metallic non-print areas on the printing surface contains a polymeric or oligomeric component. The polymeric component adheres to the metal (particularly, aluminum) surface of the non-print area(s) of the printing member, and has a hydrophilic portion. The conditioned printing plate is particularly useful for printing single fluid inks having an emulsified hydrophilic fluid phase.

21 Claims, No Drawings

LITHOGRAPHIC PRINTING METHOD AND MATERIALS

FIELD OF THE INVENTION

The present invention relates to lithographic printing methods, particularly for printing inks that do not require a separate fountain solution, and for materials used in such printing methods

BACKGROUND OF THE INVENTION

In lithographic printing, an inked printing member, e.g., an inked printing plate, contacts and transfers an inked image to a rubber blanket, and then the blanket contacts and transfers the image to the substrate being printed. Lithographic plates have image areas with a relatively oleophilic surface and non-image areas with a relatively hydrophilic surface. In a typical two-fluid lithographic printing process, the plate cylinder first comes in contact with dampening rollers that transfer an aqueous fountain solution that wets out the hydrophilic non-image areas of the plate. The dampened plate then contacts an inking roller, accepting the ink only in the oleophilic image areas. The fountain solution helps to keep the ink out of the non-image areas. The press operator must continually monitor the printing process to insure that the correct balance of the fountain solution and the ink is maintained so that the ink adheres to the printing areas, but only the printing areas, of the plate in order to produce a sharp, well-defined print.

Printing plates can be made by altering the ink-receptiveness of a blank plate with digitally controlled equipment to produce the desired image on the plate. Typical two-fluid lithographic printing plates typically have non-image areas that are metallic with an oxidized, hydrophilic surface. A finisher is applied over the surface of the plate to provide temporary protection. The imaged plate is then attached to the plate cylinder of the printing press. The finisher is removed during the make-ready process to re-expose the oleophilic image and hydrophilic non-image regions of the plate. Sometimes a print run is interrupted or a plate will be re-used at a later time. In such cases, a protective material, or gum, is applied to the plate surface to avoid damage to the plate and contamination with substances (dirt, oil, fingerprints, etc.) that could affect the characteristics of the hydrophilic and oleophilic areas. Like the finisher, the gum is applied in a layer over the entire surface of the plate. Typically, a gum such as gum arabic is used with two-fluid lithographic inks, which washes away during the press run. Sometimes a gum is included in the fountain solution to replace the gum that is worn away by the operation of the press. If the press is stopped during the run, the gum may provide a minor amount of protection to the plate.

The industry has long sought an offset printing process and associated materials that would not require a separate fountain solution. Waterless plates have been made by applying to the non-image area a silicone rubber, which has a very low surface energy and is not wetted by the ink. The silicone-modified plates are expensive, however, and require expensive, specially-cooled press equipment because the fountain solution of the traditional two-fluid method also serves as a coolant. Other efforts have been directed to producing a single-fluid lithographic ink, i.e., an ink that does not require a separate fountain solution, that can be used with the industry-standard printing plates that have metallic non-image surfaces.

Kingman et al., U.S. Pat. No. 6,140,392, describe single fluid lithographic printing inks having a continuous phase that includes an acid-functional vinyl resin and a discontinuous polyol phase that includes a liquid polyol. Latunski et al., co-pending U.S. application Ser. No. 10/054,261, filed Jan. 21, 2002 describes single fluid lithographic printing inks having a continuous phase including a hydrogen-bonding vinyl polymer and an emulsified phase including water and/or liquid polyol. These compositions are stable in the fountain and print lithographically without toning and without use of a separate fountain solution. It has been found, however, that for conventional plates that have metallic non-image areas, a single fluid in will, over time, remove any gum or other material used to treat the non-image areas of such plates. After the gum is removed, the ink may begin to tone. The toning is believed to be caused by the non-image areas no longer being hydrophilic enough to create sufficient separation of the continuous phase and the emulsified fluid phase of the single fluid ink. While conventional dual-fluid lithographic processes may replenish the gum on the plate with a fountain solution containing a gum, this approach has been ineffective for printing single fluid lithographic inks.

SUMMARY OF THE INVENTION

The present invention is directed to methods and materials for printing a single fluid ink, particularly using a printing plate having metallic non-image areas, without experiencing the toning problem during an extended printing run.

In general, single fluid inks that print with traditional printing plates—that is, plates having hydrophilically modified non-image areas and oleophilic print areas—have an emulsified hydrophilic fluid phase and a continuous phase containing the printing ink components. The emulsified hydrophilic fluid phase contains water and/or hydrophilic polyols and monoalcohols. To print cleanly and without toning, the emulsified hydrophilic fluid phase must selectively cover the hydrophilically-modified non-image areas of the plate, keeping the non-image areas clean of any of the hydrophobic ink phase. The non-image areas of a metal printing plate, particularly an aluminum printing plate, have a surface having -M-O-M- groups, where M is the metal, for example in the usual case of an aluminum printing plate the non-image areas will have —Al—O—Al— groups.

According to the invention, the printing plate is treated with a conditioner composition that increases the hydrophilicity of the non-image areas. Unlike a treatment with a finisher or a gum, the conditioner surface is durable in the non-image areas but not durable in the image areas of the plate. In another aspect of the invention, the treated plate is used for printing with a single fluid ink having an emulsified hydrophilic fluid phase and a continuous, oleophilic ink phase, the ink phase containing a polymer or oligomer that hydrogen bonds with the fluid phase.

The conditioner composition contains a polymeric or oligomeric component. [As used herein, "polymeric" will refer to both polymeric and oligomeric; "polymer" will refer to both polymer and oligomer.] The polymeric component has a hydrophilic portion and adheres to the metal (particularly, aluminum) surface of the non-image area or areas of the printing plate. The polymeric component may be one polymer capable of adhering to the non-image area and having a hydrophilic segment or segments, or the polymeric component may include a combination of polymers, with one or more polymers being capable of adhering to the metal surface of the non-image area(s) and one or more polymers being hydrophilic or having a hydrophilic portion.

The conditioner composition forms a durable film in the non-image area(s) of the printing plate. A "durable" film according to the invention is one that adheres to the non-image area or areas of the printing member during printing for a desired time. For a film to be durable, the film-forming polymer (or one of the film-forming polymers, if a combination of polymers is employed) should have sufficient attachment to the non-image portion of the plate so that it is not entirely removed by being dissolved by the hydrophilic fluid of a single fluid lithographic ink or fountain solution of a two-fluid lithographic ink. The film should also be sufficiently abrasion resistant not to be entirely worn away by the contact with inking rollers and the blanket cylinder during printing. The type and amount of interaction of the polymeric component with the non-image surface is selected to provide a sufficient attachment for the conditioner film to remain in the non-image areas during printing. If a film does not have sufficient abrasion resistance, the abrasion resistance may be increased in different ways, including increasing the molecular weight of one or more polymers of the polymeric component, by increasing the amount of polymer adhering to the non-image area, by introducing crosslinking of the film (e.g., through UV cure of unsaturated polymers or reaction with a crosslinking agent or self-crosslinking), or by using a polymer or polymers with higher glass transition temperatures in the polymeric portion.

"A" and "an" as used herein indicate "at least one" of the item is present; a plurality of such items may be present, when possible.

The conditioned plate may be used for lithographic printing using a single fluid lithographic printing composition that includes a oleophilic phase with affinity for the image areas of the plate and an emulsified hydrophilic fluid phase. A preferred single fluid lithographic printing composition has a hydrophobic phase comprising a hydrogen bonding polymer, particularly a hydrogen bonding vinyl polymer, and a hydrophilic fluid phase containing water, a liquid polyol, or both water and a liquid polyol. The terms "vinyl resin" and "vinyl polymer" are used synonymously to refer to polymers prepared by chain reaction polymerization, or addition polymerization, through carbon-carbon double bonds, using vinyl monomers (such as acrylic and methacrylic monomers, other vinyl monomers including vinyl esters and vinyl aromatic monomers including styrene) and other ethylenically unsaturated monomers copolymerizable with these. The term "hydrogen bonding" polymers refers to those polymers having groups that can form hydrogen bonds with the emulsified hydrophilic fluid phase.

The hydrogen bonding polymers are preferably branched by including in the polymerization reaction vinyl monomers that have two or more, preferably two reaction sites or by reacting the polymer with a limited amount of crosslinker during or after polymerization. A non-vinyl polymer may be branched by using one or more monomers having three or more reactive groups, as is well-known in the art. The "branched" hydrogen bonding polymer is one that remains usefully soluble in organic solvents, rather than a polymer that is crosslinked into an insoluble, three-dimensional network structure that can only be swelled by solvents. The branched vinyl polymers of the invention unexpectedly retain solubility in spite of significant branching.

DETAILED DESCRIPTION OF THE PREFERRED EMBODIMENTS

The conditioner composition contains a film-forming polymeric or oligomeric component. First, the polymeric component comprises functionality that interacts with the metallic surface (particularly, aluminum surface) to adhere to the metallic surface of the non-image area(s). Functionality that may be used to provide the desired adhesion to the non-image areas, particularly to metal oxide surfaces, includes, without limitation, aldehyde groups, carboxylic acid groups, phosphorous groups having at least one active hydrogen, including

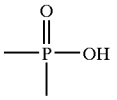

groups, mono- and di-phosphate esters, phosphonic acid groups, mono-phosphonate esters, and phosphonous acid groups; sulfonic acids;

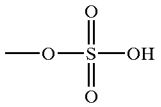

groups; silanol groups —Si—OH; and combinations of these. When the printing plate has aluminum non-image areas, particularly —Al—O—Al— groups in the non-image areas, it is preferred to include functional groups selected from aldehyde groups, mono- and di-phosphate ester groups, and combinations of these on one or more polymers in the polymeric component.

The functionality of the polymeric component that provides adhesion to the non-image areas may be on one or more polymers. Specific examples of suitable polymers that can be used to provide adhesion of the conditioner film to the non-image area(s) of the plate include, without limitation, shellac, copolymers of vinyl hydrogen phosphates and/or vinyl phosphonic acid and/or monoesters of vinyl phosphonic acid, and hydrogen phosphate esters of polyethylene oxide materials, particularly such esters in which any hydrocarbon ester group has 10 or fewer carbon atoms and the poly(ethylene oxide) moiety or moieties have at least 10 ethylene oxide monomer units, preferably 10 to 20 ethylene oxide monomer units. Examples of such hydrogen phosphate ester of polyethylene oxide materials include, without limitation, phenyl poly(ethylene oxide) hydrogen phosphate, 2-ethylhexyl poly(ethylene oxide) hydrogen phosphate, and butyl poly(ethylene oxide) hydrogen phosphate.

The polymeric component also has a hydrophilic portion. The hydrophilic portion may be a part of the same polymer or polymers having functionality that adheres the film to the non-image area(s) of the printing plate. The hydrophilic portion may in addition, or instead, be a part of one or more separate polymers that have no such functionality. Hydrophilic, film-forming polymers are known, and include, for example, polymers with one or more poly(ethylene glycol) segments, including and block copolymers of ethylene oxide; homopolymers and copolymers of hydrophilic addition monomers such as hydroxyethyl acrylate, hydroxyethyl methacrylate, hydroxypropyl acrylate, hydroxypropyl methacrylate, acrylic acid, methacrylic acid, crotonic acid, maleic anhydride, vinyl acetate hydrolyzed after polymerization to the alcohol, methyl vinyl ether, and vinyl pyrrolidone; and graft copolymers having hydrophilic portions. Specific examples of suitable polymers that can be used to provide the hydrophilic portion of the conditioner film include, without limitation, poly(vinyl alcohol) polymers, including those with minor amount of copolymerized vinyl hydrogen phosphate; poly(vinyl pyrrolidone); copolymers of hydroxyalkyl acrylates and/or hydroxyalkyl methacrylates; hydrogen phosphate esters of polyethylene oxide materials, particularly such esters in which any hydrocarbon ester group has 10 or fewer carbon atoms and the poly (ethylene oxide) moiety or moieties have at least 10 ethylene oxide monomer units, preferably 10 to 20 ethylene oxide monomer units; and vinyl polymers containing branches with poly(ethylene oxide) segments. Examples of such hydrogen phosphate ester of polyethylene oxide materials include, without limitation, phenyl poly(ethylene oxide) hydrogen phosphate, 2-ethylhexyl poly(ethylene oxide) hydrogen phosphate, and butyl poly(ethylene oxide) hydrogen phosphate. Examples of copolymers of hydroxyalkyl acrylates and/or hydroxyalkyl methacrylates include those having from about 0.5% to about 5%, preferably from about 1% to about 3%, of a comonomer with functionality that provides adhesion to the non-image area.

The polymeric portion may contain one or more further resins or polymers. It may, for example, be desirable to include a polymer to improve the durability of the film formed by the conditioner. Suitable examples of further polymers that may be used in the conditioner include, without limitation, styrenated acrylics e.g. styrene/acrylic acid copolymers, styrene/maleic acid copolymers, half-esters, half-amides, or half-imides of styrene/maleic acid copolymers, and so on.

In general, the polymeric component may be included in the conditioner composition in amounts of from about 1% to about 50% by weight, preferably from about 5% to about 35% by weight, more preferably from about 5% to about 25% by weight in the conditioning composition. For easier application, the amount of the polymeric component in the conditioner may be limited so that the conditioner remains fluid. It is preferred to have up to about 50%, more preferably up to about 35%, and still more preferably up to about 25% by weight of the polymeric component in the conditioner composition. The conditioner may contain an amount of the polymeric component that will facilitate forming an effective film in the non-image areas. If the conditioner composition has too little of the polymeric component, it may be necessary to apply multiple coats of the conditioning composition or thick coats that require a longer time to dry. It is preferred to have at least about 1%, more preferably at least about 2%, and still more preferably at least about 5% by weight of the polymeric component in the conditioner composition. If too much of the polymeric component is in the conditioner composition, the conditioner composition may be thicker and more difficult to apply to the printing plate. Further, a thicker layer of the conditioner composition on the plate than necessary may make it harder to remove the unattached material from the image areas or otherwise may prolong the time needed to bring the plate to its optimum printing performance.

The conditioning composition is preferably fluid for ease of application to the printing plate. The conditioner composition preferably includes water, one or more liquid alcohols, or both water and one or more liquid alcohols. In general, aqueous compositions are preferred, but the conditioning composition may also have an alcoholic medium or other medium compatible with the polymeric component. Combinations of water and alcohols, including liquid polyols, are also preferred.

The polymeric component may be dissolved, emulsified, or dispersed in the conditioner composition, or part of the polymeric component may be dissolved and part of the polymeric component emulsified and/or dispersed in the conditioner composition.

In a preferred embodiment, the conditioner composition further includes at least one acid-functional salt of a hydrophilic, organic polyacid material, in particular a salt of a polycarboxylic acid. Suitable examples of partial salts of hydrophilic, organic polyacids include, without limitation, partial lithium salts, alkaline earth metal salts, particularly magnesium and calcium salts, transition metal salts, particularly copper salts, iron salts, manganese salts, and zinc salts, ammonium salts, and mixed cation partial salts thereof of oxalic acid, citric acid, tartaric acid, phthalic acid, terephthalic acid, isophthalic anhydride (which hydrolyzes in the presence of water to the acid), hexahydro- and tetrahydro-versions of the phthalic acids, including hexahydrophthalic acid, tricarballylic acid, benzene tetracarboxylic acid, trimellitic acid, malic acid, malonic acid, sulfosuccinic acid, cysteic acid, diglycolic acid, aspartic acid, citraconic acid, 3-hydroxy-3-methylglutaric acid, fumaric acid, gallic acid, and so on. Preferred salts include magnesium hydrogen tartrate, zinc hydrogen tartrate, magnesium hydrogen tartrate, lithium hydrogen tartrate, and calcium hydrogen tartrate.

Preferred hydrophilic salts in general are prepared using acids that have a ratio of the number of atoms that can participate in hydrogen bonding to total number of atoms [in each case, excluding hydrogen atoms] of about 1:4 or more, preferably about 1:3 or more.

The conditioning composition may have at least about 0.5%, preferably at least about 1% more preferably at least about 2% by weight of the salt. The conditioning composition may include up to about 12%, preferably up to about 10%, more preferably up to about 6% by weight of the salt.

The conditioning composition is preferably applied to a clean printing plate, although in some cases it may even be applied after a finisher or gum is applied to the plate. It is also possible to apply additional conditioner composition to the plate after an initial period of printing with the plate. The applied conditioner is allowed to dry and form a film. Although the thickness of the film is not critical, the film should be durable, as already described. In generally, a film at least about 1 micron thick is desirable, but this thickness may be varied considerably depending upon the type of plate, the duration of the print run, the particular ink used in printing, and so on.

One embodiment of the method of the invention includes applying the conditioner to the printing plate in a first step to produce a treated printing plate and then washing the treated printing member in a second step with a composition containing water, one or more liquid alcohols (particularly polyols), or both water and one or more liquid alcohols (particularly polyols). A liquid polyol is an organic liquid with at least two hydroxyl groups. Polyethylene glycol oligomers such as diethylene glycol, triethylene glycol, and tetraethylene glycol, as well as ethylene glycol, propylene glycol, 1,3-propanediol, dipropylene glycol, 1,4-butanediol, and glycerol are examples of useful liquid polyols. Useful monoalcohols include methanol, ethanol, and isopropyl alcohol. The washing composition may be used instead to wash the printing member after it has been used for printing, for example if printing is stopped for an interval and then resumed, or the printing member may be washed both before and after printing.

In a particularly preferred embodiment, the plate is prepared for printing with a single fluid ink and the conditioned printing plate is washed with the composition of the hydrophilic emulsified phase of the single fluid lithographic ink that will be printed using the printing plate.

In another aspect of the invention, the conditioning composition is applied to a printing plate and allowed to form a film on the printing member.

In yet another aspect of the invention, the conditioning composition is applied to a printing member and a polymeric component is reacted to form a cured film on the printing member. The crosslinking may be accomplished using a crosslinking agent reactive with one or more polymers in the polymeric component and providing the necessary curing conditions (e.g., heat for a thermally curing combination of polymer and crosslinking agent), by using one or more self-crosslinking polymers in the polymeric component and inducing cure (e.g., thermal or oxidative cure), or by exposing one or more radiation-curable polymers in the polymeric component to radiation. Crosslinking mechanisms are widely known generally. For example, without limitation, polycarboxylic acids, e.g. maleic acid, or polyamines, e.g. diaminopropanol, can be used to lightly crosslink materials having two or more glycidyl groups, including hydrophilic epoxy oligomers.

The conditioned printing plate is used for printing. The conditioned printing plate may also be used for printing in a two-fluid lithographic process, using a Ithographic ink and a separate fountain solution. The conditioned printing plate has been found to be particularly useful for printing with a single fluid ink having an emulsified, hydrophilic phase.

In a preferred embodiment, the conditioned printing plate prepared according to the invention is used in printing with a single fluid ink containing an emulsified, hydrophilic phase and a continuous, hydrophobic phase containing a polymer that can hydrogen bond with the hydrophilic phase. Preferably, the polymer that can hydrogen bond with the hydrophilic phase is branched.

A preferred single fluid lithographic printing ink composition has a hydrophobic phase comprising a hydrogen bonding polymer, particularly a hydrogen bonding vinyl polymer, and a hydrophilic fluid phase containing water, a liquid polyol, or both water and a liquid polyol. The hydrophobic phase may contain further polymers and/or resins suitable for ink vehicles as well as pigments, while the hydrophilic fluid phase may contain additional materials as well as additives such as weak acids or weak bases to enhance the hydrogen bonding strength of the fluid. The preferred single fluid lithographic ink compositions have a sufficient amount of hydrogen bonding between the hydrophobic phase and the hydrophilic phase so that the single fluid ink does not separate in the fountain and a sufficiently limited amount of hydrogen bonding between the hydrophobic phase and the hydrophilic phase so that during application of the ink the emulsion breaks and the water and/or polyol comes to the surface, wetting out the non-image areas of the plate having the conditioner film. Inks that are stable in the fountain but break quickly to separate on the plate print cleanly without toning and provide consistent transfer characteristics. Proper stability also may depend upon the particular hydrogen bonding vinyl polymer and the particular polyol chosen. The content of hydrogen bonding groups and molecular weight of the polymer and the amount of the hydrogen bonding polymer in the ink may be adjusted to provide the desired stability. In general, it is believed that an increase in hydrogen bonding groups on the polymer should be accompanied by a decrease in the amount of such resin included in the hydrophobic phase.

The hydrophilic fluid phase includes water, one or more liquid polyols, or both water and one or more liquid polyols. Polyethylene glycol oligomers such as diethylene glycol, triethylene glycol, and tetraethylene glycol, as well as ethylene glycol, propylene glycol, 1,3-propanediol, dipropylene glycol, 1,4-butanediol, and glycerol are examples of liquid polyols that are preferred for the hydrophilic fluid phase of the single-fluid ink of the invention. The emulsified phase may, of course, include mixtures of different liquid polyols or a mixture of water and one or more liquid polyols. In general, higher molecular weight liquid polyols may be preferred when the vinyl polymer of the hydrophobic phase has a higher equivalent weight with respect to the hydrogen bonding groups.

The emulsified phase may include further materials. In one embodiment, the emulsified phase may also include one or more solid polyols. The solid polyols may be selected from solid polyol compounds and solid polyol oligomers. Examples include, without limitation, 2,3-butanediol, 1,6-hexanediol and other hexanediols, pentaerythritol, dipentaerythritol, hydroxyl hyperbranched dendrimers, trimethylolethane, trimethylolpropane, neopentyl glycol, 2,2,4-trimethyl-1,3-pentanediol, 1,4-cyclohexanedimethanol, and hydrogenated bisphenol A. Compounds having one hydroxyl group and up to about 18 carbon atoms, preferably up to about 8 carbon atoms may also be included, such as cyclohexanol and stearyl alcohol. The emulsified phase may also include a weak acid such as citric acid, tartaric acid, or tannic acid, or a weak base such as triethanolamine, which may be included in an amount of from about 0.01 weight percent up to about 2 weight percent of the ink composition.

Lithographic, single-fluid inks may be formulated with from about 5% up to about 50%, preferably from about 10% to about 35%, and particularly preferably from about 20% to about 30% of the emulsified fluid phase by weight based on the total weight of the ink composition. Unless another means for cooling is provided, there is preferably a sufficient amount of emulsified fluid in the ink composition to keep the plate at a workably cool temperature, preferably at least about 5% by weight, more preferably at least about 10% by weight, and even more preferably at least about 15% by weight, and up to about 50% by weight, preferably up to about 35% by weight, and more preferably up to about 30% by weight. The amount of the emulsified fluid phase necessary to achieve good printing results without toning may depend upon the kind of plate being used and may be determined by straightforward testing.

Proper stability of the preferred single fluid lithographic ink may depend upon the particular hydrogen-bonding vinyl polymer and the particular components of the emulsified phase chosen. The hydrogen bonding equivalent weight and molecular weight of the vinyl polymer, as well as the concentration of the vinyl polymer in the continuous phase, may be adjusted to provide the desired stability. Vinyl polymers with higher levels of hydrogen bonding groups (lower equivalent weights) can generally be used in lower amounts, but in general the concentration of hydrogen bonding groups may not be excessively high or else the vinyl polymer will not be sufficiently soluble in the continuous phase. Destabilizing interactions, such as between an additional polymer, resin, or other material of the continuous phase and the emulsified fluid phase, is avoided. In general, additional materials that are more hydrophilic than the hydrogen-bonding vinyl polymer are avoided.

The hydrophobic phase of the preferred single-fluid ink includes at least a vinyl polymer having groups that can hydrogen bond with one or more components of the hydrophilic fluid phase. The hydrogen bonding vinyl polymers of the invention are prepared by polymerization of a monomer mixture that includes one or more monomers that contain hydrogen bonding groups or by adducting the polymer with hydrogen bonding groups or converting other groups to the desired hydrogen bonding groups after polymerization. The vinyl polymers of the invention are advantageously branched by including in the polymerization reaction monomers that have two reaction sites or by reacting the polymer with a material having a plurality of groups reactive with the polymer. When the vinyl polymer is branched, it nonetheless remains usefully soluble. By "soluble" it is meant that the polymer can be diluted with one or more solvents. (By contrast, polymers may be crosslinked into gels, which are insoluble, three-dimensional network structures that are only be swelled by solvents.) The branched vinyl resins of the invention unexpectedly retain solvent dilutability in spite of significant branching.

The hydrogen bonding vinyl polymers of the single fluid ink may be prepared by polymerizing a monomer mixture that includes at least one monomer that contains a hydrogen bonding group or a group that can be converted to or adducted with a hydrogen bonding group after polymerization. Among preferred hydrogen bonding groups are carboxylic acid groups, carboxylic anhydride groups, primary amines or amines having alkyl substituents of three or fewer carbon atoms on the nitrogen atom, primary amides or amides having alkyl substituents of three or fewer carbons on the nitrogen atom, esters having pendant alkyl groups of three or fewer carbon atoms, β-hydroxyl esters, hydroxyls, or sulfur-containing groups.

Carboxyl-functional vinyl polymers may be prepared by polymerization of a monomer mixture that includes at least one acid-functional monomer or at least one monomer that has a group that is converted to an acid group following polymerization, such as an anhydride group. Examples of acid-functional or anhydride-functional monomers include, without limitation, α,β-ethylenically unsaturated monocarboxylic acids containing 3 to 5 carbon atoms such as acrylic, methacrylic, and crotonic acids; α,β-ethylenically unsaturated dicarboxylic acids containing 4 to 6 carbon atoms and the anhydrides and monoesters those acids, such as maleic anhydride, maleic acid monomethyl ester, and fumaric acid; and acid-functional derivatives of copolymerizable monomers, such as the hydroxyethyl acrylate half-ester of succinic acid. Acid functionality may also be provided by other known means, such as by reaction of an hydroxyl group with an anhydride or by hydrolysis of an ester, such as by hydrolysis of a tert-butyl methacrylate monomer unit. It is preferred to include an acid-functional monomer such as acrylic acid, methacrylic acid, or crotonic acid, or an anhydride monomer such as maleic anhydride or itaconic anhydride that may be hydrated after polymerization to generate acid groups. It is preferred for the acid-functional vinyl polymer to have an acid number of at least about 3 mg KOH per gram nonvolatile, preferably an acid number of from about 6 to about 30 mg KOH per gram nonvolatile, and more preferably an acid number of from about 8 to about 25 mg KOH per gram nonvolatile, based upon the nonvolatile weight of the vinyl polymer.

Examples of amines and amide groups include, without limitation, primary amides, N-alkylamides in which the N-alkyl group has three or fewer carbon atoms, N,N'-dialkylamides in which each N-alkyl group has three or fewer carbon atoms, primary amines, N-alkylamines in which the N-alkyl group has three or fewer carbon atoms, N,N'-dialkylamines in which the N-alkyl group has three or fewer carbon atoms, phosphonamides, and sulfonamides. Examples of suitable amine and amide functional, ethylenically unsaturated monomers include, without limitation, acrylamide, methacrylamide, p-dimethylaminostyrene, N-, dimethylaminoethyl methacrylate, aminopropyl methacrylate, aminoethyl acrylate, aminopropyl acrylate, aminoethyl methacrylate, 1-vinyl-2-pyrrolidinone, N-alkylacrylamides, N-alkylmethacrylamides, N,N'-dialkylacrylamides, and N,N'-dialkylmethacrylamides, in which the alkyl group have 3 or fewer carbon atoms. Specific examples include N-methylacrylamide, N-methylmethacrylamide, N-isopropyl acrylamide, N-isopropyl methacrylamide, N,N-dimethylacrylamide, N,N'-dimethylmethacrylamide, N,N'-diisopropylmethacrylamide, N-vinyl formamide, and combinations of these.

Examples of sulfur-containing groups include sulfonic acids, sulfonamides, sulfoxides, sulfones, and mercaptans. Mercaptans may be included as chain transfer agents. Examples of suitable monomers include, without limitation, 2-acrylamido-2-methylpropane sulfonic acid, methyl vinyl sulfone, methyl vinyl sulfoxide, and sodium vinyl sulfonate. A copolymer of sodium vinyl sulfonate may be acidified, then treated with dialkylamine to give the sulfonamide.

Examples of monomers providing phosphorous-containing groups include, without limitation, vinyl phosphoric acid, which may be esterified to give the phosphate or amidified with dialkylamine to give the phosphonamide.

Examples of suitable ethylenically unsaturated hydroxyl monomers include, without limitation, hydroxyethyl acrylate, hydroxypropyl acrylate, hydroxybutyl acrylate, hydroxyethyl methacrylate, hydroxypropyl methacrylate, and hydroxybutyl methacrylate. Hydroxyl-functional groups may also be obtained on the vinyl polymer, for example, by hydrolysis of ester groups, e.g. hydrolysis of vinyl acetate monomer units to vinyl alcohol, or by reaction of an acid group with an oxirane group, e.g. reaction of a glycidyl methacrylate monomer unit with acetic acid or reaction of a methacrylic acid monomer unit with ethylene oxide. It is preferred to add weakly basic materials to the hydrophilic fluid phase in order to strengthen the hydrogen bonding between the hydroxyl-functional vinyl polymer and the components of the hydrophilic fluid phase.

Suitable esters include methyl, ethyl, n-propyl, and isopropyl esters of polymerizable acids, for example methyl methacrylate, ethyl acrylate, monomethyl maleate, diethyl maleate, and so on, as well as ethylenically unsaturated esters of saturated acids having up to four carbon atoms such as the formate, acetate, propionates, and butyrates of hydroxyethyl acrylate or hydroxyethyl methacrylate or vinyl formate, vinyl acetate, vinyl propionates, and vinyl butyrates.

Acetoacetate groups are also useful for hydrogen bonding and monomers containing the acetoacetate group may be obtained by reacting an allyl halide with 2, 4-pentanedione that has been treated with a strong base (e.g., KOH) to produce the stabilized carbanion. The resulting acetoacetate-functional monomer is copolymerized to provide an acetoacetate-functional vinyl polymer. Another acetoacetate-functional monomer is acetoacetoxyethyl methacrylate.

The hydrogen bonding vinyl polymer of the preferred single fluid ink may also contain a combination of the above functional groups capable of forming hydrogen bonding interactions. The vinyl polymer preferably has an equivalent weight, based on the hydrogen bonding groups, of preferably at least about 1800 g/equivalent, more preferably at least about 2200 g/equivalent, and preferably up to about 20,000 g/equivalent, more preferably up to about 7200 g/equivalent.

The hydrogen bonding group of the vinyl polymer may be a hydrogen donating species and/or a hydrogen accepting species. It will be appreciated that the vinyl polymer and the hydrophilic fluid may have the same chemical functional group participating as both the donor species and the acceptor species of the hydrogen bond pair. For example, hydroxyl groups on the vinyl polymer may interact with hydroxyl groups of the hydrophilic phase. By the same token, the donor and acceptor species may be different chemical groups. For example, an amide group may hydrogen bond with an hydroxyl group. In addition, some functional groups on the hydrogen bonding vinyl polymers may serve as acceptor species, others as donor species, and others as both. In general, the water and/or polyol(s) of the hydrophilic fluid phase can act both as acceptors and donors.

The strength of a hydrogen bond is related to the relative acidity and basicity of the donor and acceptor species. If it is desired to strengthen the hydrogen bond formed between a donor with a weakly acidic hydrogen atom and an acceptor, it is possible to add acidic materials to the donor species to increase its hydrogen bonding affinity. Alternatively, a weakly basic material may be added to a hydrogen acceptor to increase the strength of a hydrogen bond. In some situations, ionic interaction may be moderated and controlled by appropriate additions of weak acids and weak basis to the donor and acceptors.

The hydrogen bonding vinyl polymers are preferably branched. In one embodiment, the hydrogen bonding vinyl polymers are significantly branched. The vinyl polymer is branched but usefully soluble. The branched vinyl polymers are diluted, rather than swollen or dispersed, by addition of solvent. The branching may be accomplished by a number of methods. In a first method, a monomer with two or more polymerizable double bonds is included in the polymerization reaction. In a second method, a pair of ethylenically unsaturated monomers, each of which has in addition to the polymerizable double bond at least one additional functionality reactive with the additional functionality on the other monomer, are included in the monomer mixture being polymerized. A third method consists of crosslinking the polymer with a crosslinker having at least two functional groups that react with functional groups on the polymer.

Preferably, the vinyl resin is polymerized using at least one monomer having two or more polymerizable ethylenically unsaturated bonds. Illustrative examples of monomers having two or more ethylenically unsaturated moieties include, without limitation, (meth)acrylate esters of polyols such as 1,4-butanediol di(meth)acrylate, 1,6-hexanediol di(meth)acrylate, neopentyl glycol di(meth)acrylate, trimethylolpropane tri(meth)acrylate, tetramethylolmethane tetra(meth)acrylate, pentaerythritol tetra(meth)acrylate, dipentaerythritol penta(meth)acrylate, dipentaerythritol hexa(meth)acrylate, alkylene glycol di(meth)acrylates and polyalkylene glycol di(meth)acrylates, such as ethylene glycol di(meth)acrylate, butylene glycol di(meth)acrylate, diethylene glycol di(meth)acrylate, triethylene glycol di(meth)acrylate, and polyethylene glycol di(meth)acrylate; divinylbenzene, allyl methacrylate, diallyl phthalate, diallyl terephthalate, and the like, singly or in combinations of two or more. Of these, divinylbenzene, butylene glycol dimethacrylate, butanediol dimethacrylate, trimethylolpropane triacrylate, and pentaerythritol tetra-acrylate are highly preferred, and divinylbenzene is still more highly preferred.

Preferably, the branched vinyl polymer is polymerized using at least about 0.008 equivalents per 100 grams of monomer polymerized of at least one monomer having at least two ethylenically unsaturated polymerizable bonds, or 0.004 equivalents per 100 grams of monomer polymerized of each of two monomers having mutually reactive groups in addition to an ethylenically unsaturated polymerizable bond. Preferably, the branched vinyl polymer is polymerized using from about 0.012 to about 0.08 equivalents, and more preferably from about 0.016 to about 0.064 equivalents per 100 grams of monomer polymerized of the polyfunctional monomer or monomers having at least two ethylenically unsaturated polymerizable bonds or of the pair of monomers having one polymerization bond and one additional mutually reactive group. The polyfunctional monomer or monomers preferably have from two to four ethylenically unsaturated polymerizable bonds, and more preferably two ethylenically unsaturated polymerizable bonds. In one embodiment it is preferred for the branched vinyl resin to be prepared by polymerizing a mixture of monomers that includes from about 0.5% to about 6%, more preferably from about 1.2% to about 6%, yet more preferably from about 1.2% to about 4%, and even more preferably from about 1.5% to about 3.25% divinylbenzene based on the total weight of the monomers polymerized. Commercial grades of divinylbenzene include mono-functional and/or non-functional material. The amount of the commercial material needed to provide the indicated percentages must be calculated. For example, 5% by weight of a material that is 80% by weight divinylbenzene/20% mono-functional monomers would provide 4% by weight of the divinylbenzene fraction.

The optimum amount of divinylbenzene or other monomer having at least two polymerizable ethylenically unsaturated bond that is included in the polymerization mixture depends to some extent upon the particular reaction conditions, such as the rate of addition of monomers during polymerization, the solvency of the polymer being formed in the reaction medium chosen, the amount of monomers relative to the reaction medium, the half-life of the initiator chosen at the reaction temperature and the amount of initiator by weight of the monomers, and may be determined by straightforward testing.

Alternatively, the polymers can be crosslinked by including in the monomer mixture at least a pair of monomers having at least one functionality reactive with the functionality of the other monomer. Preferably, the reaction of the additional functional groups takes place during the polymerization reaction, although this is not seen as critical in the formation of a polymer according to the invention and the reaction of the additional functional groups may be carried out partially or wholly before or after polymerization. A variety of such pairs of mutually reactive groups is possible. Illustrative examples of such pairs of reactive groups include, without limitation, epoxide and carboxyl groups, amine and carboxyl groups, epoxide and amine groups, epoxide and anhydride groups, amine and anhydride groups, hydroxyl and carboxyl or anhydride groups, amine and acid chloride groups, alkylene imine and carboxyl groups, organoalkoxysilane and carboxyl groups, isocyanate and hydroxyl groups, cyclic carbonate and amine groups, isocyanate and amine groups, and so on. When the hydrogen bonding groups are included as one of the reactive groups, they are used in a sufficient excess to provide the desired hydrogen bonding functionality in the vinyl resin. Specific examples of such monomers include, without limitation, glycidyl (meth)acrylate with (meth)acrylic acid, N-alkoxymethylated acrylamides (which react with themselves) such as N-isobutoxymethylated acrylamide, gamma methacryloxytrialkoxysilane (which reacts with itself), and combinations thereof. In connection with the description of this invention, the term "(meth)acrylate" will be used to refer to both the acrylate and the methacrylate esters, the term "(meth)acrylic" will be used to refer to both the acrylic and the methacrylic compounds, and so on.

The polymers may also be branched by subjecting the polymer to reaction with a limited amount of a crosslinking compound after polymerization. The amount of crosslinking is limited so that the vinyl polymer remains soluble in the continuous phase. Such crosslinkers include at least two functional groups reactive with functional groups on the polymer. The reactive groups on the crosslinker may be the same or different, and the crosslinker will be selected according to what functional groups are present on the polymer. It should be noted that many of the hydrogen bonding functional groups on the hydrogen bonding vinyl polymer are capable of being crosslinked. Generally, such crosslinking occurs at a low stoichiometric ratio so that after such crosslinking there are still available hydrogen bonding groups to form hydrogen bonds with components of hydrophilic fluid phase as described above. Examples of crosslinkers include, without limitation, polycarboxylic acids, polyamines, polyisocyanates, and polyhydroxyl containing species. Non-limiting examples of crosslinkers include diethylene glycol, triethylene glycol, hexanediamine, adipic acid, neopentyl glycol, dipropylene glycol, tripropylene glycol, 1,4-cyclohexanedimethanol, 1,6-hexanediol, 1,3-butanediol, hydrogenated bisphenol A, 2,2,4-trimethyl-1,3-pentanediol, and the like.

Aluminum gellants may also be used as the external crosslinker. Such aluminum gellants may be aluminum salts, aluminum organic complexes, or aluminum alkoxides. The aluminum gellants crosslink the hydrogen bonding vinyl polymer by forming aluminum alkoxide bridges between reactive groups on the polymer. Specific examples of aluminum gellants useful in the invention include, without limitation, aluminum acetoacetonate, aluminum triisopropoxide, aluminum tris-sec-butoxide, aluminum diisopropoxide aceto ester, aluminum oxyacylate (OAO from Chattem Chemicals), and combinations of these. In addition, alkoxylated titanates and zirconates may be used, for example, without limitation, di(cumyl)phenyl oxoethylene titanate, di(dioctyl) phosphato ethylene titanate, diisopropyl distearoyl titanate, the corresponding zirconates, and combinations of these. Combinations of aluminum gellants, alkoxylated titanates, and alkoxylated zirconates are also useful.

Other monomers that may be polymerized along with the monomers containing hydrogen bonding groups include, without limitation, higher esters of α,β-ethylenically unsaturated monocarboxylic acids containing 3 to 5 carbon atoms such as butanol and higher alcohol esters of acrylic, methacrylic and crotonic acids; butanol and higher diesters of α,β-ethylenically unsaturated dicarboxylic acids containing 4 to 6 carbons; butyrate and higher vinyl esters, vinyl ethers, vinyl ketones such as vinyl ethyl ketone, and aromatic or heterocyclic aliphatic vinyl compounds.

Representative examples of suitable esters of acrylic, methacrylic, and crotonic acids include, without limitation, those esters from reaction with saturated aliphatic and cycloaliphatic alcohols containing 4 to 20 carbon atoms, such as for example n-butyl, isobutyl, tert-butyl, 2-ethylhexyl, lauryl, stearyl, cyclohexyl, trimethylcyclohexyl, tetrahydrofurfuryl, stearyl, sulfoethyl, and isobornyl acrylates, methacrylates, and crotonates; and polyalkylene glycol acrylates and methacrylates. Representative examples of other ethylenically unsaturated polymerizable monomers include, without limitation, such compounds as diesters of fumaric, maleic, and itaconic acid with alcohols such as butanol, isobutanol, and tert-butanol. Representative examples of aromatic or heterocyclic aliphatic vinyl compounds include, without limitation, such compounds as styrene, α-methyl styrene, vinyl toluene, tert-butyl styrene, and so on. The selection of monomers is made on the basis of various factors commonly considered in making ink varnishes, including the desired glass transition temperature and the desired dilutability of the resulting polymer in the solvent or solvent system of the ink composition.

The preferred vinyl polymers may be prepared by using conventional techniques, preferably free radical polymerization in a semi-batch process. For instance, the monomers, initiator(s), and any chain transfer agent may be fed at a controlled rate into a suitable heated reactor charged with solvent in a semi-batch process.

Typical free radical sources are organic peroxides, including dialkyl peroxides, such as di-tert-butyl peroxide and dicumyl peroxide, peroxyesters, such as tert-butyl peroxy 2-ethylhexanoate and tert-butyl peroxy pivalate; peroxy carbonates and peroxydicarbonates, such as tert-butyl peroxy isopropyl carbonate, di-2-ethylhexyl peroxydicarbonate and dicyclohexyl peroxydicarbonate; diacyl peroxides, such as dibenzoyl peroxide and dilauroyl peroxide; hydroperoxides, such as cumene hydroperoxide and tert-butyl hydroperoxide; ketone peroxides, such as cyclohexanone peroxide and methylisobutyl ketone peroxide; and peroxyketals, such as 1,1-bis(tert-butyl peroxy)-3,5,5-trimethylcyclohexane and 1,1-bis(tert-butyl peroxy) cyclohexane; as well as azo compounds such as 2,2'-azobis(2-methylbutanenitrile), 2,2'-azobis(2-methyl)propionitrile, and 1,1'-azobis(cyclohexanecarbonitrile). Organic peroxides are preferred. Particularly preferred is tert-butyl peroxy isopropyl carbonate The particular initiator and amount of initiator used depends upon factors known to the person skilled in the art, such as the reaction temperature, the amount and type of solvent (in the case of a solution polymerization), the half-life of the initiator, and so on.

Chain transfer agents may also be used in the polymerization. Typical chain transfer agents are mercaptans such as octyl mercaptan, n- or tert-dodecyl mercaptan, thiosalicylic acid, mercaptocarboxylic acids such as mercaptoacetic acid and mercaptopropionic acid and their esters, and mercaptoethanol; halogenated compounds; and dimeric alpha-methyl styrene. Preferably, no chain transfer agent is included because of odor and other known drawbacks.

The addition polymerization such as by free radical polymerization is usually carried out in solution at temperatures from about 20° C. to about 300° C., preferably from about 150° C. to about 200° C., more preferably from about 160° C. to about 165° C. Preferably, the polymerization is carried out with approximately the same reaction temperature and using the same initiator(s) throughout. The initiator should be chosen so its half-life at the reaction temperature is preferably no more than about thirty minutes, particularly preferably no more than about five minutes, and yet more preferably no more than about two minutes. Particularly preferred are initiators having a half-life of less than about one minute at a temperature of from about 150° C. to about 200° C. In general, more of the branching monomer can be included when the initiator half-life is shorter and/or when more initiator is used. The vinyl polymer vehicles of the invention preferably have little or no residual (unreacted) monomer content. In particular, the vinyl vehicles are preferably substantially free of residual monomer, i.e., have less than about 0.5% residual monomer, and even more preferably less than about 0.1% residual monomer by weight, based on the total weight of the monomers being polymerized.

In a semi-batch process, the monomer and initiator are added to the polymerization reactor over a period of time, preferably at a constant rate. Typically, the add times are from about 1 to about 10 hours, and add times of from about three to about five hours are common. Longer add times typically produce lower number average molecular weights. Lower number average molecular weights may also be produced by increasing the ratio of solvent to monomer or by using a stronger solvent for the resulting polymer.

In general, the preferred single fluid lithographic ink contains a branched vinyl polymer having a low number average molecular weight and a broad polydispersity. The number average molecular weight $M_n$ and weight average molecular weight $M_w$ can be determined by gel permeation chromatography using polystyrene standards, which are available for up to 6 million weight average molecular weight, according to well-accepted methods. Polydispersity is defined as the ratio of $M_w/M_n$. In one embodiment, the vinyl polymer has a number average molecular weight of at least about 1000, and more preferably at least about 2000. The number average molecular weight is also preferably less than about 15,000, more preferably less than about 10,000, and even more preferably less than about 8500. A preferred range for $M_n$ is from about 1000 to about 10,000, a more preferred range for $M_n$ is from about 2000 to about 8500, and an even more preferred range is from about 4000 to about 8000. The weight average molecular weight should be at least about 30,000, preferably at least about 100,000. The weight average molecular weight is preferably up to about 60 million, based upon a GPC determination using an available standard having 6 million weight average molecular weight. A preferred range for $M_w$ is from about 30,000 to about 55 million, a more preferred range for $M_w$ is from about 100,000 to about 1 million, and a still more preferred range is from about 100,000 to about 300,000. Resins having ultra-high molecular weight shoulders (above about 45 million), which can be seen by GPC, are preferably avoided for the $M_w$ range of from about 100,000 to about 300,000. The polydispersity, or ratio of $M_w/M_n$, may be up to about 10,000, preferably up to about 1000. The polydispersity is preferably at least about 15, particularly preferably at least about 50. The polydispersity preferably falls in the range of from about 15 to about 1000, and more preferably it falls in a range of from about 50 to about 800.

The theoretical glass transition temperature (Tg) can be adjusted according to methods well-known in the art through selection and apportionment of the co-monomers. In a preferred embodiment, the theoretical $T_g$ is above room temperature, and preferably the theoretical $T_g$ is at least about 600 C, more preferably at least about 70° C. Preferred vinyl polymers have a $T_g$ of from about 50° C. to about 125° C., more preferably from about 60° C. to about 100° C., and even more preferably from about 70° C. to about 90° C. The theoretical glass transition temperature can be determined using the Fox equation.

In one embodiment of the invention, the single fluid ink contains a hydrogen bonding vinyl polymer, which may be a branched vinyl polymer, in combination with other resins in the ink composition. Examples of suitable other resins that may be combined with the hydrogen bonding vinyl polymer include, without limitation, polyester and alkyd resins, phenolic resins, rosins, cellulosics, and derivatives of these such as rosin-modified phenolics, phenolic-modified rosins, hydrocarbon-modified rosins, maleic modified rosin, fumaric modified rosins; hydrocarbon resins, other acrylic or vinyl resins, polyamide resins, and so on. When present, such resins or polymers may be included in amounts of from about 1 part by weight up to about 100 parts by weight, preferably about 3 to about 50 parts by weight, for each part by weight of the hydrogen bonding vinyl polymer of the invention, based upon the nonvolatile weights of the resins.

In addition to the hydrogen bonding vinyl resin and any optional second resin, the preferred ink compositions include one or more organic solvents. In a preferred embodiment of the invention, the branched vinyl resin forms a solution or apparent solution having no apparent turbidity in the organic solvent or solvents of the ink formulation. The particular organic solvents and amount of solvent included is determined by the ink viscosity, body, and tack desired.

In general, non-oxygenated solvents or solvents with low Kauri-butanol (KB) values are used for inks that will be in contact with rubber parts such as rubber rollers during the lithographic process, to avoid affecting the rubber. Suitable solvents for inks that will contact rubber parts include, without limitation, aliphatic hydrocarbons such as petroleum distillate fractions and normal and isoparaffinic solvents with limited aromatic character. For example, petroleum middle distillate fractions such as those available under the tradename Magie Sol, available from Magie Bros. Oil Company, a subsidiary of Pennsylvania Refining Company, Franklin Park, Ill., under the tradename ExxPrint, available from Exxon Chemical Co., Houston, Tex., and from Golden Bear Oil Specialties, Oildale, Calif., Total Petroleum Inc., Denver, Colo., and Calumet Lubricants Co., Indianapolis, Ind. may be used. In addition or alternatively, soybean oil or other vegetable oils may be included.

When non-oxygenated solvents such as these are used, it is generally advantageous to include a sufficient amount of at least one monomer having a substantial affinity for aliphatic solvents in order to obtain the desired solvency of the preferred branched vinyl polymer. In general, acrylic ester monomers having at least six carbons in the alcohol portion of the ester or styrene or alkylated styrene, such as tert-butyl styrene, may be included in the polymerized monomers for this purpose. In a preferred embodiment, an ink composition with non-oxygenated solvents includes a branched vinyl resin polymerized from a monomer mixture including at least about 20%, preferably from about 20% to about 40%, and more preferably from about 20% to about 25% of a monomer that promotes aliphatic solubility such as stearyl methacrylate or t-butyl styrene, with stearyl methacrylate being a preferred such monomer. It is also preferred to include at least about 55% percent styrene, preferably from about 55% to about 80% styrene, and more preferably from about 60% to about 70% styrene. Other monomers may also be used to reduce solvent tolerance in aliphatic solvent, if desired. All percentages are by weight, based upon the total weight of the monomer mixture polymerized. Among preferred monomer compositions for vinyl polymers for lithographic inks are those including a (meth)acrylic ester of an alcohol having 8–20 carbon atoms such as stearyl methacrylate, styrene, divinylbenzene, and a monomer containing hydrogen bonding groups. In a preferred embodiment, a branched vinyl resin for a lithographic printing ink is made with from about 15, preferably about 20, to about 30, preferably about 25, weight percent of a (meth) acrylic ester of an alcohol having 8–20 carbon atoms, especially stearyl methacrylate; from about 50, preferably about 60, to about 80, preferably about 75, weight percent of a styrenic monomer, especially styrene itself.

Preferably, the organic solvent or solvent mixture will have a boiling point of at least about 100° C. and preferably not more than about 550° C. Offset printing inks may use solvents with boiling point above about 200° C. News inks usually are formulated with from about 20 to about 85 percent by weight of solvents such as mineral oils, vegetable oils, and high boiling petroleum distillates. The amount of solvent also varies according to the type of ink composition (that is, whether the ink is for newsprint, heatset, sheetfed, etc.), the specific solvents used, and other factors known in the art. Typically the solvent content for lithographic inks is up to about 60%, which may include oils as part of the solvent package. Usually, at least about 35% solvent is present in lithographic ink. When used to formulate the preferred ink compositions of the invention, these varnishes or vehicles, including the branched vinyl resins, are typically clear, apparent solutions.

The ink compositions will usually include one or more pigments in the hydrophobic phase. The number and kinds of pigments will depend upon the kind of ink being formulated. News ink, cold set, and book black compositions typically will include only one or only a few pigments, such as carbon black, while custom color inks may include a more complicated pigment package, including colors with special effects such as pearlescence or metallic effect. Lithographic printing inks for full-color printing are typically used in four colors—magenta, yellow, black, and cyan, and custom colors may be included as desired. Any of the customary inorganic and organic pigments may be used in the ink compositions of the present invention. Alternatively, the compositions of the invention may be used as overprint lacquers or varnishes. The overprint lacquers (air drying) or varnishes (curing) are intended to be clear or transparent and thus opaque pigments are not included.

It has been observed that the print quality using the preferred lithographic ink compositions can be a function of pH under certain conditions. As noted above, a wide variety of chemical functional groups in the hydrogen bonding vinyl resin are suitable to provide lithographic single fluid ink compositions that are stable in the fountain and break when applied to the printing plate to provide high quality printed materials. It is believed that the invention operates in part on the principle of a balance between hydrogen donating ability and hydrogen accepting ability between the hydrogen bonding groups of the vinyl resin and the components of the hydrophilic fluid phase. The components of the hydrophilic fluid phase contain hydroxyl groups that have both hydrogen donating ability and hydrogen accepting ability. Depending on the hydrogen bonding vinyl resin chosen for the ink compositions of the invention, hydrogen bonding groups on the vinyl resin may have relatively higher or lower hydrogen donating or accepting ability. If the hydrogen bonding group on the polymer is relatively lower in hydrogen donating ability, then it may be preferred to put a component into the hydrophilic fluid phase to increase its relative hydrogen accepting ability to provide the proper balance. For example, when the hydrogen bonding group on the polymer is an alcohol, it has been found useful to add a weak base to the hydrophilic fluid phase. On the other hand, when the hydrogen bonding functional group on the vinyl resin is an especially strong hydrogen acceptor, care must be taken not to put additives into the hydrophilic fluid phase that would increase the hydrogen donating ability of the hydrophilic fluid phase. For example, when the hydrogen bonding group on the vinyl resin is an amine group, it is preferred not to put a weak acid into the hydrophilic fluid phase. Such a weak acid in the hydrophilic fluid phase would tend to form a salt with the amine on the vinyl resin, leading to poor performance of the ink composition, since the composition would be too stabilized by the ionic pair to break upon application to the printing plate. Inks containing vinyl resins with amine functional groups as discussed above are most effective at approximately a neutral pH.

When the hydrogen bonding functional group on the vinyl resin is an amide or an N-alkylamide, it has been observed that the proper functioning of the ink composition is nearly independent of pH. It is believed that the amide functional group has a proper balance of hydrogen accepting properties so as to accommodate either a low pH, high pH, or neutrality in the hydrophilic fluid phase. In contrast, for hydrogen bonding vinyl resins containing alcohol hydrogen bonding groups, the performance of the ink composition is dependent on the pH.

It is preferred that the hydrophilic fluid phase have Hansen solubility parameters having these values: a dispersion parameter value of at least about 6, a polarity parameter value of at least about 4, and a hydrogen bonding parameter value of at least about 10. Preferably, the hydrophilic fluid phase has Hansen solubility parameters having these values: a dispersion parameter value of from about 8.0 to about 9.0, a polarity parameter value of from about 5.0 to about 8.0, and a hydrogen bonding parameter value of from about 12 to about 20.

At least a small amount of water is often desirable in order to aid in dissolving or homogenizing the ingredients of the hydrophilic fluid phase. In general, about 4 or 5% by weight of water may be included in the hydrophilic fluid phase for this purpose. When water is present in higher amounts, and especially when the hydrophilic fluid phase is more than 50% water, adjustments are generally necessary to obtain satisfactory inks. For example, organic or inorganic salts should be added to the hydrophilic fluid phase to maintain the integrity of the emulsion. Such salts include, without limitation, monovalent or divalent salts that are at least partially soluble in the hydrophilic fluid phase. Examples of such salts include, without limitation, as lithium, sodium, potassium, magnesium, calcium, iron(II), manganese(II), copper(II), and zinc salts, particularly the acetates, hydroxyacetates, nitrates, sulfates, phosphates, hydrogen phosphates, hydrogen sulfates, chlorates, chlorides, bromides, and iodides of these metals, and the like. Such salts may be included in the hydrophilic fluid phase at up to about 5% by weight, preferably from about 0.01% to about 5% by weight, more preferably from about 0.1% to about 1.5% by weight. In addition, when the hydrophilic fluid phase contains more than about 5% water, any chemical groups that can participate in a hydrogen bond in the ink vehicles (such as the commonly used acid functional alkyd vehicles) should be used in lesser amounts. A wetting agent, such as polyvinylpyrrolidone, may be added to aid in wetting of the plate. From about 0.5 weight percent to about 1.5 weight percent of the polyvinylpyrrolidone is included, based on the weight of the ink composition.

It will be appreciated by the skilled artisan that other additives known in the art may be included in the ink compositions, so long as such additives do not significantly detract from the benefits of the present invention. Illustrative examples of these include, without limitation, pour point depressants, surfactants, wetting agents, waxes, emulsifying agents and dispersing agents, defoamers, antioxidants, UV absorbers, dryers (e.g., for formulations containing vegetable oils), flow agents and other rheology modifiers, gloss enhancers, and anti-settling agents. When included, additives are typically included in amounts of at least about 0.001% of the ink composition, and may be included in amount of about 7% by weight or more of the ink composition.

The method of the invention is suited for any lithographic applications, including, without limitation, single fluid or dual fluid heatset inks, news inks, and sheetfed inks. The ink is printed using the conditioned plate attached to the plate cylinder of the printing press.

The invention is illustrated by the following examples. The examples are merely illustrative and do not in any way limit the scope of the invention as described and claimed. All parts are parts by weight unless otherwise noted.

EXAMPLES

Example 1

Preparation of Conditioner Composition

CELVOL 502 poly(vinyl alcohol) (87–89% hydrolysis, viscosity of 5–6 centipoise for a 4% by weight aqueous solution, obtaine from Celanese Ltd.) was dissolved in water to make a 20% by weight solution. A mixture of 300 grams of the poly(vinyl alcohol) solution and 200 grams of ZINPOL 259 shellac emulsion from Noveon was maintained at room temperature while 500 grams of potable water was added to the mixture and the mixture stirred at room temperature for about five minutes.

Example 2

Preparation of Conditioned Printing Plate

A Fuji FND plate was imaged using a negative. The FND plate was then placed into a Fuji PS-800HB plate processor using a developing time of 30 seconds, having the first bath of the two-bath process being an alkaline developer Fuji DN-5M and the second bath being tap water. The squeegee action of the plate processor left the plate dry to the touch after being developed.

The Conditioner Composition of Example 1 was applied to the plate using a cotton WEB-RIL wipe (a sheeted cotton ball wipe), and the plate was buffed lightly until dry.

Example 3

Preparation of Conditioned Printing Plate

A Fuji FND plate was imaged using a negative. The FND plate was then placed into a Fuji PS-800HB plate processor using a developing time of 30 seconds, having the first bath of the two-bath process being an alkaline developer Fuji DN-5M and the second bath being the Conditioner Composition of Example 1. The Conditioner Composition on the plate was metered off with rollers, leaving a film dry to the touch.

Example 4

Lithographic Printing Using Conditioned Printing Plate

The Conditioned Printing Plate of Example 2 was mounted on a press printing unit. A commercial single fluid ink (SFI, available from Flint Ink Corp., Ann Arbor, Mich.) was added to the fountain on the printing unit. The keys and sweep were set, then the roller train was inked up for two minutes. The form rollers were dropped on the plate to check for correct lithographing, then raised. Printing was then begun and continued for 2000 sheets. Density measurements were taken from the blanket in non-image areas and the print quality (specifically, toning in the non-image areas) of the last printed sheet was observed. The results were comparable to those obtained when printing with conventional, gummed plates in two-fluid lithography using a conventional sheetfed ink in the ink fountain with a dampener containing fountain solution.

What is claimed is:

1. A method of conditioning a printing plate having a printing surface comprising one or more metal oxide non-image areas and at least one oleophilic image area, comprising a step of applying to the printing surface comprising the one or more metal oxide non-image areas and the at least one oleophilic image area a conditioner composition comprising a polymeric portion comprising functionality that adheres to the one or more non-image areas and further comprising a hydrophilic portion, wherein said conditioner composition forms a durable film in the one or more non-image areas but not in image areas and increases the hydrophilicity of the one or more non-image areas.

2. A method according to claim 1, wherein after applying the conditioner composition to the printing surface the polymeric portion is reacted to form a cured film.

3. A method of conditioning a printing member having a printing surface comprising one or more non-image areas having -M-O-M- groups, wherein M is a metal atom, and at least one oleophilic image area, said method comprising a step of applying to the printing surface comprising the one or more non-image areas and the at least one oleophilic image area a conditioner composition comprising a polymeric portion, wherein said polymeric portion comprises functionality that interacts with the -M-O-M- groups to form a durable film and further wherein the conditioner composition comprises a polymeric portion that increases the hydrophilicity of the one or more non-image areas.

4. A method according to claim 3, wherein for at least art of the -M-O-M- groups M is Al.

5. A method of conditioning a printing plate, comprising a step of applying to one or more non-image areas of the printing plate a conditioning composition comprising a polymeric portion, said polymeric portion comprising a hydrophilic portion and a portion that adheres to non-image areas but not to image areas of the printing plate.

6. A method according to claim 5, wherein the one or ore non-image areas comprise aluminum oxide.

7. A method according to claim 6, wherein the portion that adheres to non-image areas comprises functionality selected from the group consisting of aldehyde groups, carboxylic acid groups, phosphorous groups having at least one active hydrogen, including

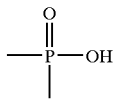

groups, mono- and di-phosphate esters, phosphoric acid groups, mono-phosphonate esters, and phosphonous acid groups; sulfonic acids;

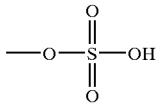

groups; silanol groups —Si—OH; and combinations thereof.

8. A method of conditioning a printing plate, comprising a step of applying to the surface of a printing plate having image areas and non-image areas a conditioning composition comprising a polymeric portion that forms a durable film in only the non-image areas of the printing plate, said film comprising a hydrophilic portion.

9. A method according to claim 8, wherein the conditioning composition further comprises at least one acid-functional salt of an organic, polyacid.

10. A method according to claim 8, wherein the conditioning composition further comprises a carboxylic acid-functional salt of a polycarboxylic acid.

11. A method according to claim 8, wherein the conditioning composition further comprises at least one member selected from the group consisting of carboxylic acid-functional lithium salts, alkaline earth metal salts, transition metal salts, ammonium salts, and mixed cation salts thereof of oxalic acid, citric acid, tartaric acid, phthalic acid, terephthalic acid, isophthalic acid, hexahydro- and tetrahydro-versions of phthalic acid, terephthalic acid, and isophthalic acid, tricarballylic acid, benzene tetracarboxylic acid, trimellitic acid, malic acid, malonic acid, sulfosuccinic acid, cysteic acid, diglycolic acid, aspartic acid, citraconic acid, 3-hydroy -3-methylglutaric acid, fumaric acid, gallic acid, and combinations thereof.

12. A method according to claim 8, wherein the conditioning composition further comprises at least one member selected from the group consisting of magnesium hydrogen tartrate, zinc hydrogen tartrate, magnesium hydrogen tartrate, lithium hydrogen tartrate, and calcium hydrogen tartrate.

13. A method of treating a printing plate having metal oxide non-image areas, comprising:

applying to the printing plate having image areas and metallic non-image areas a conditioner composition comprising a polymeric component and forming hydrophilic film therefrom, wherein said polymeric component comprises functionality to adhere the film to non-image areas so that the film is durable in the non-image areas during printing; and washing the printing plate with a composition comprising a member selected from the group consisting of water, liquid alcohols, and combinations the thereof.

14. A method of lithographic printing, comprising treating a printing plate according to claim 13, wherein the washing step is carried out before a further step of lithographically printing using the printing plate.

15. A method according to claim 13, wherein the polymeric portion comprises a combination of polymers.

16. A method according to claim 13, wherein the polymeric portion comprises one or more polymers having functionality that adheres to the non-image areas and one or more polymers having a hydrophilic portion.

17. A method according to claim 13, wherein the polymeric portion comprises one or more members selected from the group consisting of shellac, copolymers of vinyl hydrogen phosphates, copolymers of viny phosphoric acid, copolymers of monoesters of vinyl phosphoric acid, hydrogen phosphate esters of polyethylene oxides in which any hydrocarbon ester group has 10 or fewer carbon atoms and the poly(ethylene oxide) moiety or moieties have at least 10 ethylene oxide monomer units, block copolymers of ethylene oxide, homopolymers and copolymers of at least one monomer selected from the group consisting of hydroxyalkyl acrylates, hydroxyalkyl methacrylates, acrylic acid, methacrylic acid, crotonic acid, maleic anhydride, maleic acid, vinyl acetate hydrolyzed after polymerization to the alcohol, methyl vinyl ether, and vinyl pyrrolidone; and combinations thereof.

18. A method according to claim 13, wherein the polymeric portion comprises at least one member selected from the group consisting of phenyl poly(ethylene oxide) hydrogen phosphate, 2-ethylhexyl poly(ethylene oxide) hydrogen phosphate, and butyl poly(ethylene oxide) hydrogen phosphate, poly(vinyl alcohol) polymers, and copolymers of hydroxyalkyl (meth)acrylates and comonomer with functionality selected from the group consisting of aldehyde groups, carboxylic acid groups, phosphorous groups having at least one active hydrogen, including

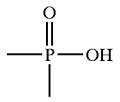

groups, mono- and di-phosphate esters, phosphoric acid groups, mono-phosphonate esters, and phosphonous acid groups; sulfonic acids;

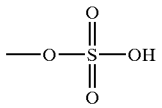

groups; silanol groups —Si—OH; and combinations thereof.

19. A method according to claim 18, wherein the conditioner composition further comprises a carboxylic acid-functional salt of a polyacid, said polyacid having a ratio of the number of atoms that can participate in hydrogen bonding to the total number of atoms of at least about 1:4.

20. A method of conditioning a printing plate, comprising a step of applying to the printing surface comprising one or more metal oxide non-image areas and at least one oleophilic image area a composition comprising a polymeric portion, wherein the polymeric portion comprises a hydrophilic polymer and comprises functionality selected from the group consisting of aldehyde groups, carboxylic acid groups, phosphorous groups having at least one active hydrogen, sulfonic acids,

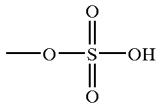

groups, silanol groups, and combinations thereof, wherein a durable film is formed in the non-image areas but not in the image area or areas.

21. A method according to claim 20, wherein the polymeric portion comprises a copolymer of a monomer mixture comprising a monomer having a mono-phosphate ester group or a di-phosphate ester group and a monomer selected from the group consisting of hydroxyethyl methacrylate, hydroxyethyl acrylate, and combinations thereof.

* * * * *

UNITED STATES PATENT AND TRADEMARK OFFICE

CERTIFICATE OF CORRECTION

PATENT NO. : 6,854,391 B2
DATED : February 15, 2005
INVENTOR(S) : Mark D. Latunski et al.

It is certified that error appears in the above-identified patent and that said Letters Patent is hereby corrected as shown below:

Column 2,
Line 13, "in" should be -- ink --.

Column 15,
Line 48, "600 C" should be -- 60° C --.

Column 20,
Line 27, "art" should be -- part --.
Line 35, "ore" should be -- more --.
Line 48, "phosphoric" should be -- phosphonic --.

Column 21,
Line 15, "3-hydroy" should be -- 3-hydroxy --.
Line 27, after "forming" insert -- a --.
Line 34, after "combinations" delete "the".
Line 48, "viny phosphoric" should be -- vinyl phosphonic --.
Line 49, "phosphoric" should be -- phosphonic --.

Column 22,
Line 7, after "and" insert -- a --.
Line 17, "phosphoric" should be -- phosphonic --.

Signed and Sealed this

Thirtieth Day of August, 2005

JON W. DUDAS
*Director of the United States Patent and Trademark Office*